United States Patent [19]

Godec et al.

[11] 4,167,280

[45] Sep. 11, 1979

[54] PANIC EXIT MECHANISM

[75] Inventors: Max Godec; Stephen G. Branson, both of Indianapolis, Ind.

[73] Assignee: Ingersoll-Rand Company, Woodcliff Lake, N.J.

[21] Appl. No.: 927,101

[22] Filed: Jul. 24, 1978

[51] Int. Cl.[2] ..... E05C 3/16

[52] U.S. Cl. ..... 292/92; 70/92; 292/21

[58] Field of Search ..... 292/92, 31, 168, 223, 292/41, 166, 221, 227, DIG. 37; 70/92

[56] References Cited

U.S. PATENT DOCUMENTS

| | | | |
|---|---|---|---|
| 1,127,721 | 2/1915 | Bazille | 292/DIG. 37 |
| 1,672,901 | 6/1928 | North | 292/DIG. 37 |
| 3,024,053 | 3/1962 | Cox et al. | 292/21 |
| 3,432,631 | 3/1969 | Deutscher et al. | 70/92 |
| 3,614,145 | 10/1971 | Zawadzki | 292/92 |
| 3,663,047 | 5/1972 | Zawadzki | 70/92 X |
| 3,730,574 | 5/1973 | Zawadzki | 292/92 |
| 3,854,763 | 12/1974 | Zawadzki | 292/92 X |
| 4,006,471 | 2/1977 | Pappas | 292/92 X |
| 4,083,590 | 4/1978 | Folger | 292/92 |

FOREIGN PATENT DOCUMENTS

| | | | |
|---|---|---|---|
| 811561 | 8/1951 | Fed. Rep. of Germany | 292/92 |

*Primary Examiner*—J. Franklin Foss

*Attorney, Agent, or Firm*—Bernard J. Murphy

[57] ABSTRACT

A panic exit latch and actuator mechanism includes an elongated latch bolt actuator element rectilinearly movable along its axis and disposed in an elongated horizontally extending housing traversing a door. A push plate is supported for movement outwardly and inwardly relative to the housing. A pair of bell cranks provide an operative connection between the push plate and the actuator element to move the actuator element from its latch projected position to its latch retracted position in response to inward movement of the push plate. The bell cranks are mounted for pivotal movement about their apices in the housing, one crank being mounted adjacent either end of the housing. The pivotal axes of the bell cranks extend generally transversely to the direction of motion of the latch bolt actuator element. Each bell crank includes an arm pivotally connected to the latch bolt actuator element and arm pivotally connected to the push plate.

10 Claims, 8 Drawing Figures

PANIC EXIT MECHANISM

This invention relates to latches and actuator mechanisms, and primarily to such mechanisms of the push plate type. Such mechanisms are frequently referred to in the art as panic exit devices.

Devices of the general type to which the instant invention relates are described in Zawadski, U.S. Pat. No. 3,663,047 and Zawadski, U.S. Pat. No. 3,767,238.

It is an object of the present invention to provide an improved and simplified latch and actuator mechanism of the general type described in the aforementioned U.S. Patents.

According to the instant invention, a latch and actuator mechanism includes an elongated latch bolt actuator element rectilinearly movable along its axis and disposed in an elongated horizontally extending housing traversing a door. A push plate is supported on the housing for movement outwardly and inwardly relative thereto. Means are provided for operatively connecting the push plate to the actuator element to move the actuator element from its latch projected position to its latch retracted position in response to inward movement of the push plate. The operative connection providing means includes a bell crank mounted for pivotal movement about its apex in the housing, the pivotal axis of the bell crank extending generally transversely to the direction of motion of the latch bolt actuator element. The bell crank includes an arm pivotally connected to the latch bolt actuator element and an arm pivotally connected to the push plate.

According to an illustrative embodiment of the instant invention, a second bell crank is provided, the first-mentioned bell crank being connected to the push plate and the actuator element adjacent one end thereof, and the second bell crank being connected to the push plate and actuator element adjacent the other end thereof.

Further according to the illustrative embodiment, the means for connecting the push plate to the bell crank includes a connection providing movement of the bell crank arm radially about the apex pivot of the bell crank while the push plate moves only generally perpendicularly to the direction of actuator element travel. The last-mentioned connection is provided by a slot in the first arm of each bell crank, the slot extending generally longitudinally of the first arm, and a pin on the push plate. The pin extends into the slot and rides against the side wall thereof.

According to the illustrative embodiment, the bell crank has a generally U-shaped cross section including two facing side walls and a bottom wall, the side walls serving to stiffen the arms of the bell crank.

The invention may best be understood by referring to the following description and accompanying drawings which illustrate the invention. In the drawings.

Figure 1:
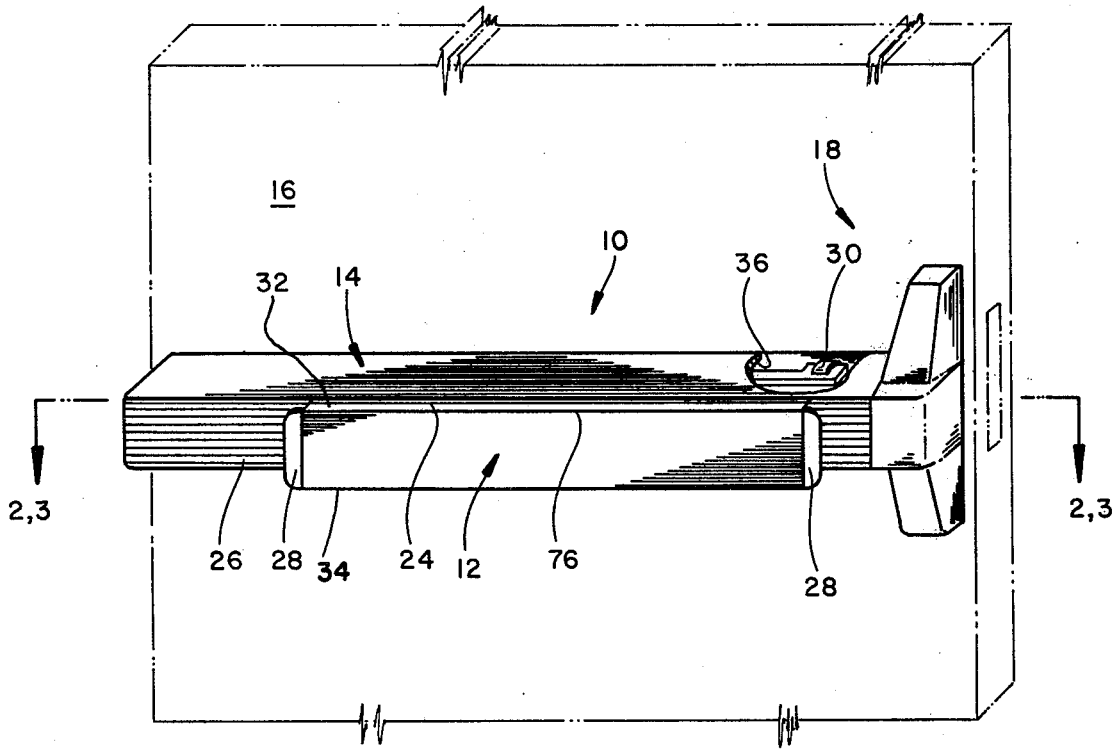
FIG. 1 is an isometric view, partly broken away, of a device constructed according to the present invention mounted on a door.

The panic exit latch and actuator apparatus 10 of the instant invention includes a push bar 12 supported for movement outwardly and inwardly relative to a mechanism case 14 which is mounted on a door 16 to extend generally horizontally across the door, and a center case 18 housing a movable latch bolt actuator mechanism 20 (FIGS. 2, 3, 7 and 8) which is actuable by movement of push bar 12 inwardly of mechanism case 14 toward the door 16 surface.

With particular reference to FIGS. 2–6, mechanism case 14 includes a base plate 22 which is mounted on the door 16 surface and supports apparatus 10 therefrom. The mechanism case 14 is generally in the shape of an elongated narrow box with an opening 24 in the front surface 26 thereof movably to receive the push bar 12. In the illustrated embodiment, push bar 12 is an extrusion which is fitted with a pair of end caps 28, each of which supports vertically upper and lower rollers 30 (only the lower ones of which can be seen in FIG. 2) adjacent the top and bottom sides 32, 34, (FIGS. 1, 5), respectively of push bar 12. Rollers 30 engage the top and bottom inside walls 36, 38, (FIGS. 1–3, 5), respectively, of mechanism case 14 to provide the limited inward and outward movement of push bar 12 with respect to mechanism case 14.

Mechanism case 14 includes a pair of guide bases 40, 42 mounted from the rearward side (door side) 44 thereof. Guide base 40 is mounted adjacent the center case 18 end of mechanism case 14 and guide base 42 is mounted adjacent the opposite end of mechanism case 14. Each of guide bases 40, 42 includes a pair of vertically spaced apart internal bosses 46, 48, (FIG. 5), and a generally oval-shaped opening 50 in a side wall 52 thereof. Guide bases 40, 42 are attached to rearward side 44 by a plurality of screws 54. Each of guide bases 40, 42 also includes a pair of opposed side walls 56, 58. Each of side walls 56, 58 includes an elongated slot 60 (FIGS. 4, 6), 62 (FIGS. 2, 3), respectively, the long dimension of which extends generally parallel to the longitudinal extent of mechanism case 14.

A bell crank 64 is supported between the bosses 46, 48 of guide base 40 for pivotal movement about a bell crank axle 66. A bell crank 68 is supported between the bosses 46, 48 of guide base 42 for pivotal movement about a bell crank axle 70. Each of bell cranks 64, 68 includes a first arm 72 which projects into the push bar 12 center port 74 between inside surfaces 76, 78 of walls 32, 34 thereof.

Each of guide bases 40, 42 includes a nylon insert 79 in a rectangular opening in each of its side walls 56, 58. The surfaces 76, 78 of push bar 12 ride against these nylon inserts 79 to center push bar 12 in the mechanism case 14 and to provide smooth, free sliding action of push bar 12 between its extremes in mechanism case 14.

Each of surfaces 76, 78 is provided with a cylindrical projection 80. A sleeve 82 extends between surfaces 76, 78 adjacent the distal end 84 of each of first arms 72, the sleeves 82 being supported between respective pairs of projections 80.

Figure 4:
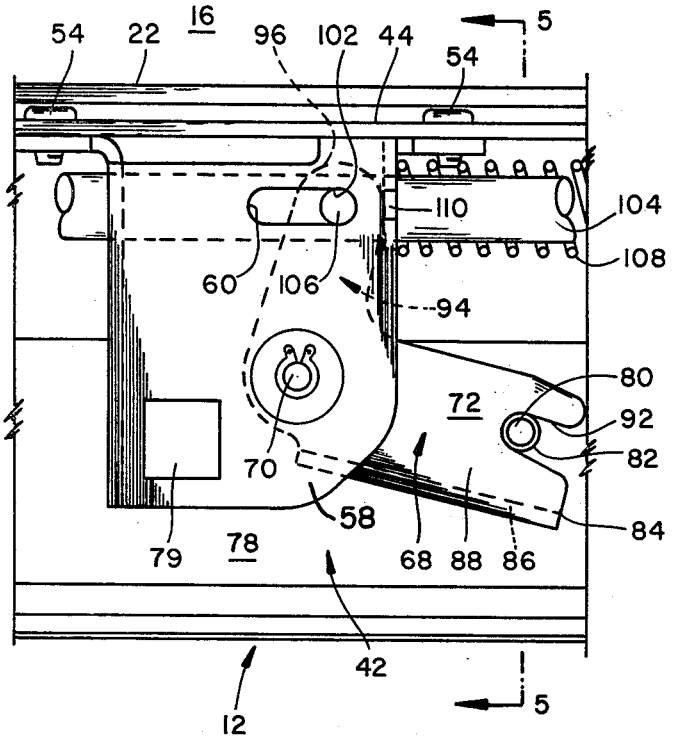
FIG. 4 is an enlarged fragmentary view of a detail of the apparatus of the instant invention.
Figure 5:
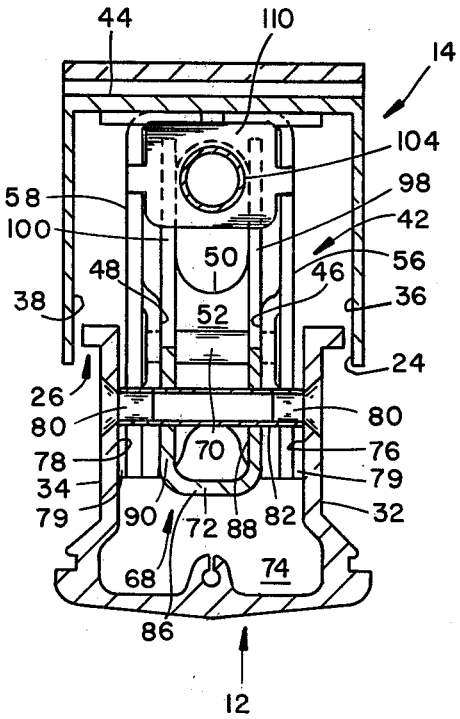
FIG. 5 is a fragmentary sectional view taken generally along section lines 5—5 of FIG. 4.
Figure 6:
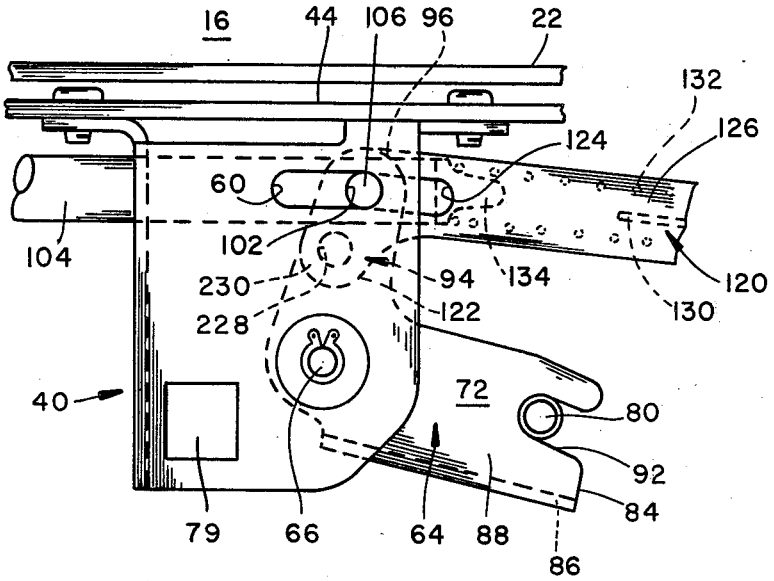
FIG. 6 is an enlarged fragmentary view of a detail of the apparatus of the instant invention.

Each of first arms 72 is formed to have a generally C-shaped vertical cross section with a front wall 86, an upper strengthening side wall 88 and a lower strengthening side wall 90, as best seen in FIG. 5. Each side wall 88, 90 includes a slot 92 (FIGS. 2, 3, 4, 6) which extends from the distal ends 84 of arm 72 generally radially toward bell crank axle 66, 70. Slots 92 are sized to receive the sleeves 82 movably.

Each of bell cranks 64, 68 includes a second arm 94 which extends generally radially of the bell crank axle 70 and includes a distal end 96. The second arm 94 is provided by a pair of generally parallel side walls 98, 100 spaced apart by wall 86 of first arm 72. Side walls 98, 100 define aligned apertures 102 near the distal ends 96 of arms 94.

A tubular action rod 104 extends longitudinally through the mechanism case 14 and is supported in the oval-shaped openings 50 of guide bases 40, 42 for movement through these openings. Action rod 104 is supported upon a pair of action rod pins 106 which are fixed in aligned apertures in the action rod 104 and extend through the apertures 102 in the side walls 98, 100 of second arms 94. It will be appreciated that inward movement of the push bar 12 is transmitted through bell cranks 64, 68 to move action rod 104 to the left in FIGS. 2–3, and that outward movement of push bar 12 in mechanism case 14 moves action rod 104 to the right in FIGS. 2–3.

Figure 3:
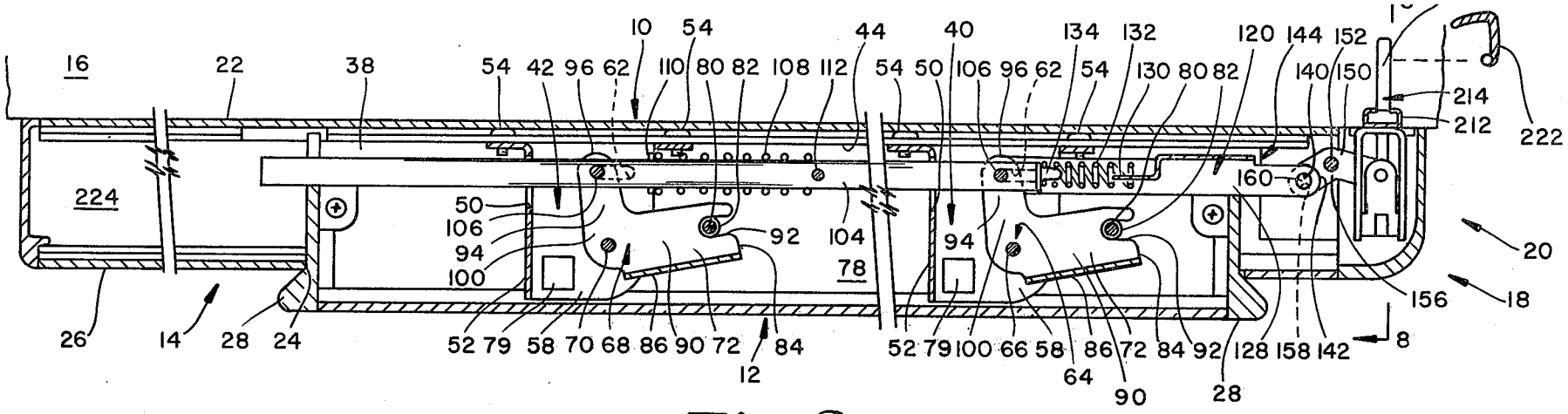
FIG. 3 is a fragmentary sectional view of the device of FIG. 1 taken generally along section lines 2,3–2,3 thereof, the device as illustrated in FIG. 3 being in an actuated or pushed position.
Figure 2:
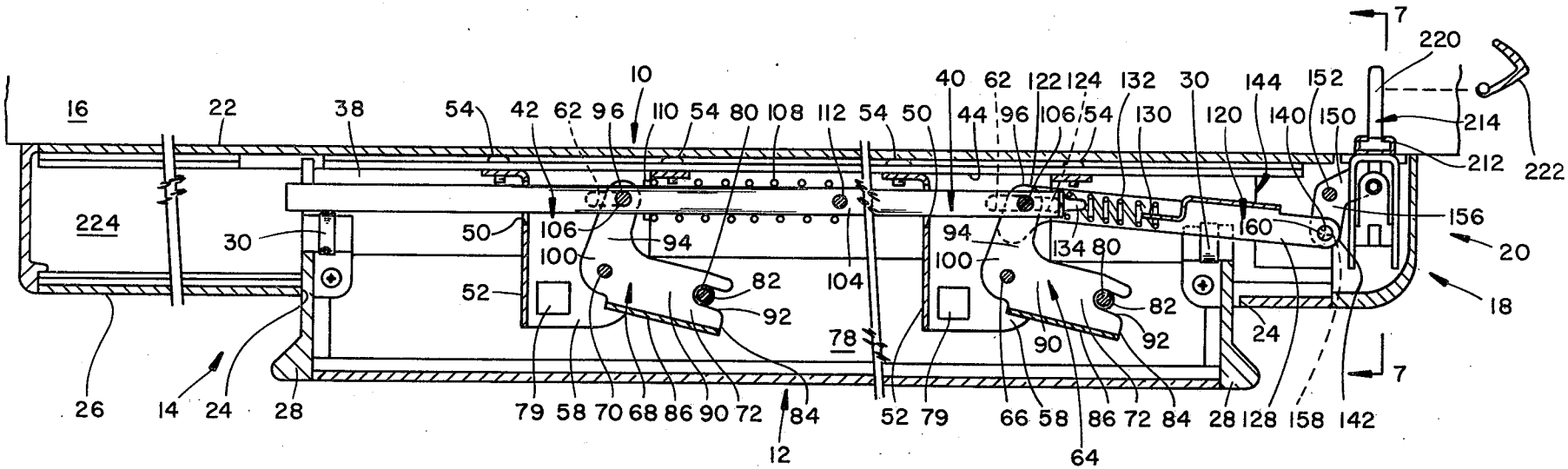
FIG. 2 is a fragmentary sectional view of the device of FIG. 1 taken generally along section lines 2,3–2,3 thereof, the device as illustrated in FIG. 2 being in a normal, or non-actuated position.

To insure that action rod 104 normally assumes its rightward orientation, and that push bar 12 normally assumes its outermost position (illustrated in FIG. 2) with respect to mechanism case 14, an action rod and push bar return spring 108 is provided (FIGS. 2–4). The return spring 108 is captured between a spring stop 110, which is located against guide base 42, and a roll pin 112, which extends diametrically through action rod 104.

A latch bolt control linkage 120 (FIGS. 2, 3 and 6) is pivotally mounted adjacent one of its ends 122 from the same action rod pin 106 by which bell crank 64 is attached to action rod 104. A lost motion connection of control linkage 120 to action rod 104 is achieved by extending the action rod pin 106 through a slot 124 in each of the top and bottom side walls 126 (FIG. 6), 128 (FIGS. 2–3), respectively, of latch bolt control linkage 120. Slots 124 allow the latch bolt control linkage 120 to move to its retracted position during closing of the door (moved to the left in FIGS. 2–3) without any corresponding movement of action rod 104.

Latch bolt control linkage 120 is formed to provide a spring retainer 130. A latch bolt control linkage return spring 132 is mounted on the spring retainer 130. A spring retainer 134 having a head sized for insertion into the hollow end of action rod 104 locates the other end of return spring 132, the spring retainer 134 and return spring 132 action between latch bolt control linkage 120 and action rod 104 to urge latch bolt control linkage 120 to its rightward position, illustrated in FIG. 2.

With particular reference to FIGS. 2–3, latch bolt control linkage 120 includes aligned bores 140 through its side walls 126, 128 adjacent its right end 142. The right end 142 of latch bolt control linkage 120 extends through an opening 144 in mechanism case 14. The center case 18 is attached to the right end of mechanism case 14 such that the right end 142 of latch bolt control linkage 120 extends into the center case 18. A pair of cam levers 150 (FIGS. 2, 3, 7 and 8) are pivotally mounted upon a cam axle 152 which extends generally vertically across center case 18. Cam levers 150 are spaced vertically from the walls of center case 18 by a pair of cam lever spacers 154. Cam levers 150 are bell crank-shaped, each of cam levers 150 including a first arm 156, the distal end of which is provided with an aperture 158. Apertures 158 are aligned with the bores 140 in the right end 142 of latch bolt control linkage 120 when the mechanism case 14 and center case 18 are joined. A control linkage pin 160 is located in the aligned apertures 158, 140 to join first arms 156 pivotally to the right end 142 of control linkage 120.

Figure 7:
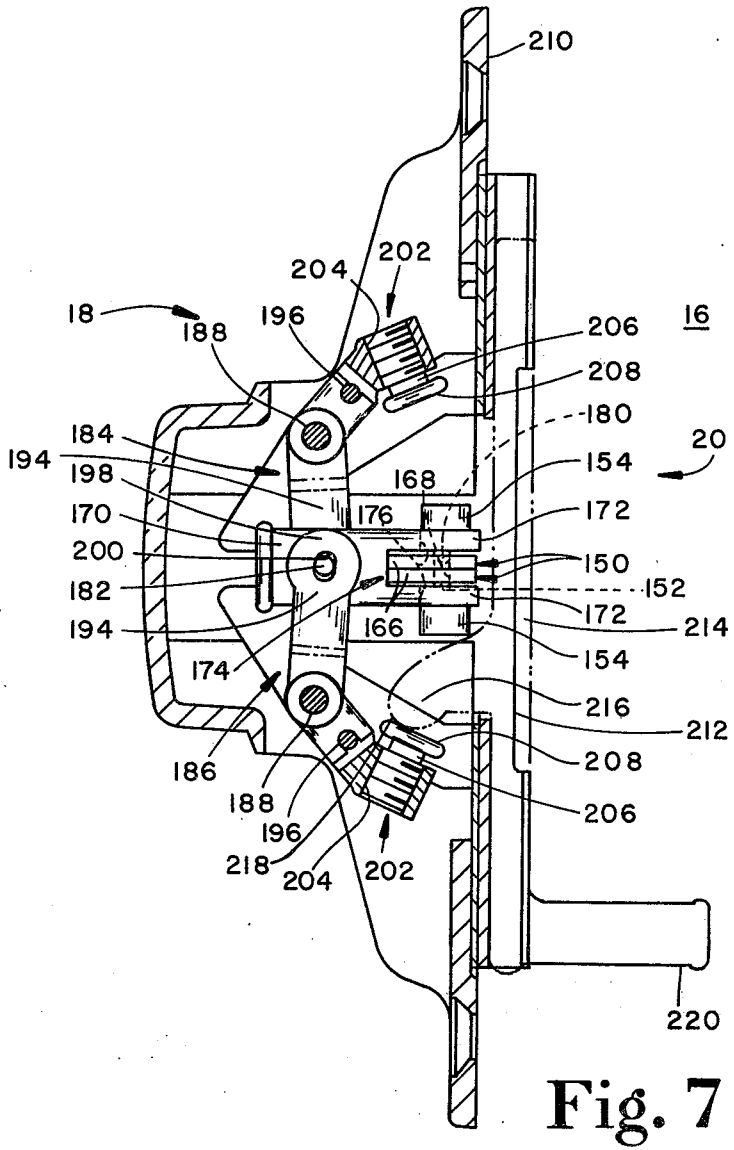
FIG. 7 is a partly fragmentary sectional view of the device of FIG. 2 taken generally along section lines 7—7 thereof; and, FIG. 8 is a partly fragmentary sectional view of the device of FIG. 3 taken generally along section lines 8—8 thereof.
Figure 8:
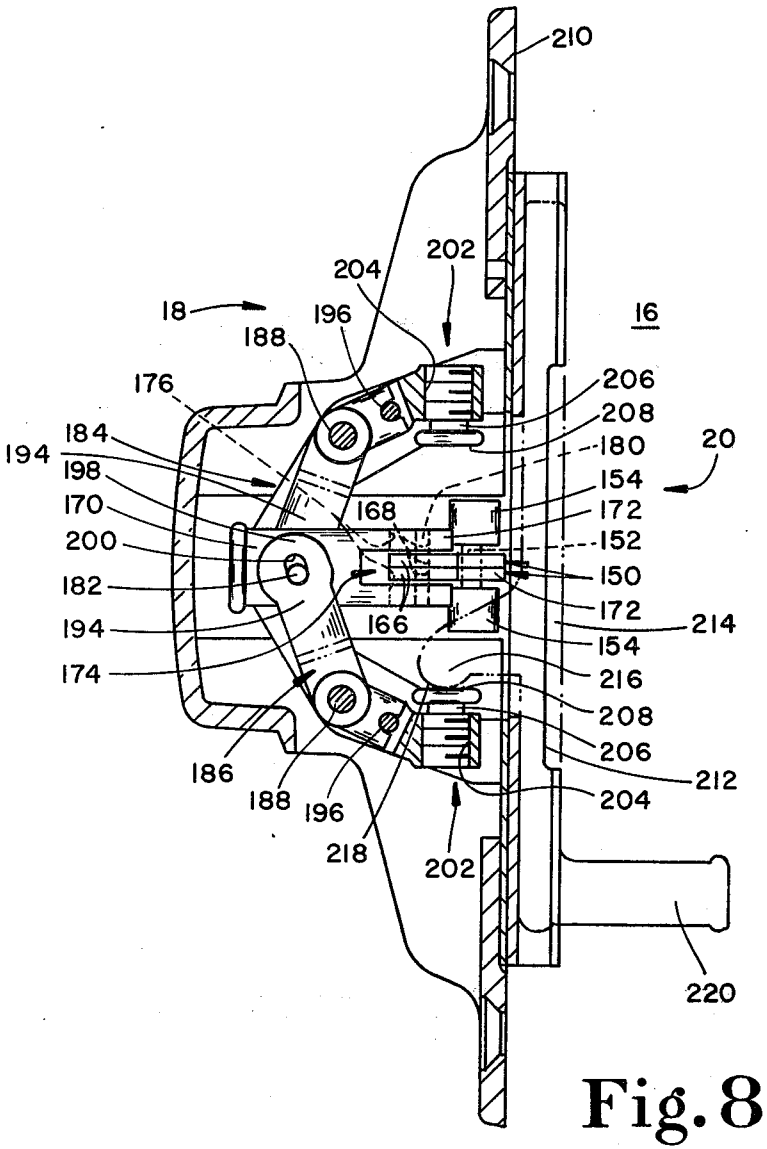

With particular reference to FIGS. 7 and 8, a second arm 166 of each of cam levers 150 extends generally toward the right end (FIGS. 2–3) in center case 18. Each second arm 166 is provided with an aperture 168 which extends generally vertically of the center case 18. A control link 170 provides a pair of ears 172 between which the distal ends 174 of arms 166 are located. Ears 172 of control link 170 are provided with elongated apertures 176, the elongated apertures 176 being aligned with apertures 168. A control linkage pin 180 is inserted through apertures 168, 176 to attach control link 170 pivotally to the distal ends 174 of arms 166.

Control link 170 includes a pair of aligned oppositely directed shafts 182 (only one of which is illustrated) which project from two opposite sides thereof generally longitudinally of mechanism case 14 (into and out of the plane of FIG. 7, 8). A pair of lever arm assemblies 184, 186, which are generally bell crank shaped, are pivotally mounted from control axles 188 between walls of the center case 18. Each lever arm assembly 184, 186 includes a first arm 194 and a second arm 196, both of which project generally radially from control axles 188. The distal ends 198 of first arms 194 include apertures 200 which are elongated slightly in the generally radial direction of first arm 194 from control axle 188. Apertures 200 pivotally receive shafts 182. The distal ends 202 of second arms 196 are provided with threaded bores 204 which extend generally perpendicular to the axes of control axles 188. Adjustment screws 206 are threaded into bores 204. Adjustment screws 206 include heads 208 which face each other generally vertically across center case 18.

As will be appreciated from FIG. 7 (the positions of the various elements of center case 18 when push bar 12 is in its rest position—not pushed) and FIG. 8 (the positions of various elements contained in the center case 18 when push bar 12 is in its pushed position), cam levers 150 are actuated by the latch bolt control linkage 120 as push bar 12 is pushed to urge the control link 170 outwardly from the door 16 to pivot lever arm assemblies 184, 186 about their control axles 188 to move heads 208 of adjustment screws 206 toward each other.

The back (door side) 210 of center case 18 is provided with a vertically extending slide housing 212. A Slider 214 is slidably received in the slide housing 212. Slider 214 includes a projection 216 on the front side thereof, the projection extending into the center case 18 and having a surface 218 which rests against one of the other of heads 208, depending upon which side of a door center case 18 is mounted upon. Movement of heads 208 toward each other as push bar 12 is pushed lifts projection 216 and slider 214. A projection 220 on the back side of slider 214 can be attached to a latch bolt 222 (illustrated in FIGS. 2–3) by known means (represented by broken lines between projection 220 and latch bolt 222 in FIGS. 2–3), movement of slider 214 actuating the latch bolt 222 to allow the door 16 to be opened.

It should be noted that the center case 18 and mechanism case 14 of the instant arrangement can be mounted on either right-hand or left-hand doors, it being necessary only to turn the center case 18 and mechanism case 14 over, and to insert the slider 214 in the slide housing 212 in the opposite direction from that shown in FIGS. 7–8 to convert these assemblies from right-hand to left-hand operation.

In many instances it may be useful to have additional means, e.g., a solenoid-and-magnet assembly for withdrawing the latch bolt 222. To this end, a housing portion 224 is provided at the left end (FIGS. 2, 3) of mechanism case 14. Such solenoid-and-magnet assembly can be housed in this housing portion 224. An additional action rod (not shown) can be provided, the additional action rod extending between the solenoid-and-magnet assembly and additional mating apertures 228 (FIG. 6) provided on ears 230 of the latch bolt control linkage 120. Actuation of such a solenoid-and-magnet assembly would move latch bolt control linkage 120 to the left in FIGS. 2–3, withdrawing the latch bolt 222. Since latch bolt control linkage return spring 132 always urges the latch bolt control linkage 120 toward its rightmost position in FIGS. 2–3, it would only be necessary to interrupt the supply of electricity to the solenoid to return the latch bolt 222 to its latching position.

What is claimed is:

1. A panic exit latch and actuator assembly comprising a housing, a latch bolt actuator movable between a projected position and a retracted position, an actuator element, means supporting the actuator element for movement between a first position and a second position, first means providing an operative connection between the actuator element and the latch bolt to move the latch bolt toward its retracted position in response to movement of the actuator element from its first position to its second position, a push plate supported for movement outwardly and inwardly relative to the housing, second means providing an operative connection between the push plate and the actuator element to move the actuator element from its first position to its second position in response to movement of the push plate inwardly, the second means including a bell crank pivotally mounted in the housing and including one crank arm connected to the actuator element and another crank arm connected to the push plate, inward movement of the push plate acting through the bell crank to move the actuator element from its first position to its second position.

2. The apparatus of claim 1 and further comprising a second bell crank, the first-mentioned bell crank being mounted in the housing adjacent one end thereof, and attached to one end of the push plate, and the second bell crank being mounted in the housing adjacent the other end thereof and being attached to the other end of the push plate.

3. A panic exit latch and actuator mechanism comprising a retractor rectilinearly movably between a latch-projected position and a latch-retracted position, means for yieldably biasing the retractor normally toward its latch-projecting position, a push plate elongated in the direction of movement of the retractor, means for guiding the push plate for rectilinear bodily movement outwardly and inwardly in a direction perpendicular to the line of movement of the retractor, means for providing an operative connection between the push plate and the retractor to move the retractor in opposition to the biasing means away from its latch-projected position when the push plate is moved inwardly toward the retractor, a latch bolt actuator movable between a projected position and a retracted position, means for providing an operative connection between the latch bolt and the retractor to move the latch bolt toward its retracted position when the retractor is moved away from its latch-projected position, the means providing an operative connection including first and second bell cranks mounted for pivotal movement, each of the first and second bell cranks including a first arm movably connected to the push plate, the first bell crank first arm being connected to the push plate adjacent one end thereof and the second bell crank first arm being connected to the push plate adjacent the other end thereof, the second arms of the first and second bell cranks being pivotally attached to the retractor, rectilinear bodily movement inwardly of the push plate causing the retractor to be moved away from its latch-projected position.

4. A panic exit and actuator assembly comprising an elongated housing, a latch bolt actuator disposed at one end of housing and movable between a projected position and a retracted position, an elongated actuator disposed within and generally parallel to the housing, means supporting the actuator for rectilinear movement in the direction of its length, an elongated push bar generally parallel to the housing and having a portion disposed outside of the housing, means within the housing for supporting and guiding the push bar for rectilinear movement toward and away from the actuator, means providing an operative connection between the actuator and latch bolt to move the latch bolt toward its retracted position in response to movement of the actuator element in one direction, and means providing an operative connection between the push bar and the actuator element to move the actuator element in said one direction in response to movement of the push bar toward the actuator, the means providing an operative connection between the push bar and actuator including a bell crank mounted in the housing for pivotal movement about an axis which extends generally perpendicular to the direction of rectilinear movement of the actuator, the bell crank including a first arm pivotally connected to the push bar and a second arm pivotally connected to the elongated actuator.

5. Apparatus according to claim 4 and further comprising a second bell crank having a first arm pivotally connected to the push bar and a second arm pivotally connected to the actuator, the first-mentioned bell crank being disposed adjacent one end of the elongated housing and the second bell crank being located adjacent the other end of the elongated housing.

6. A latch and actuator mechanism comprising a rectilinearly movable elongated rod-like latch bolt actuator element disposed in an elongated housing for horizontally-disposed, transverse mounting thereof to a door, a push plate supported for movement inwardly and outwardly toward and away from said housing, and means providing an operative connection between the push plate and the actuator element to move the actuator element from a latch-projected position to a latch-retracted position in response to inward movement of the push plate, the means providing an operative connection including a bell crank mounted for movement about a pivot axis in the housing, the pivotal axis of the bell crank extending generally transversely to the direction of motion of the latch bolt actuator element, the bell crank including an arm pivotally connected to the latch bolt actuator element and an arm pivotally connected to the push plate.

7. The apparatus of claim 6 and further including a second bell crank, the first-mentioned bell crank being connected to the push plate and the actuator element adjacent one end thereof and the second bell crank being connected to the push plate and actuator element adjacent the other end thereof.

8. The apparatus of claim 7 wherein the means for connecting the push plate to the bell crank includes a connection providing movement of the bell crank arm radially about its pivot axis while the push plate moves only generally perpendicularly to the direction of actuator element travel.

9. The apparatus of claim 8 wherein the connection is provided by a slot adjacent the distal end of the first arm of the bell crank, the slot extending generally longitudinally of the first arm, and a pin on the push plate, the pin extending into the slot and riding against a side wall thereof.

10. The apparatus of claim 6 wherein the bell crank includes a generally C-shaped cross section portion having two facing side walls and a front wall.

* * * * *